US009367998B2

(12) United States Patent
Grabiec et al.

(10) Patent No.: US 9,367,998 B2
(45) Date of Patent: Jun. 14, 2016

(54) GAMING SYSTEM HAVING DISPLAYS WITH INTEGRATED IMAGE CAPTURE CAPABILITIES

(75) Inventors: Jacek Grabiec, Chicago, IL (US); Jeremy M. Hornik, Chicago, IL (US); Joel R. Jaffe, Glenview, IL (US); Timothy C. Loose, Chicago, IL (US); Larry J. Pacey, Chicago, IL (US); Miguel A. Vega, Chicago, IL (US); Muthu Velu, Addison, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 1103 days.

(21) Appl. No.: 12/866,186

(22) PCT Filed: Feb. 19, 2009

(86) PCT No.: PCT/US2009/034519

§ 371 (c)(1),
(2), (4) Date: Sep. 30, 2010

(87) PCT Pub. No.: WO2009/105539

PCT Pub. Date: Aug. 27, 2009

(65) Prior Publication Data

US 2011/0014975 A1 Jan. 20, 2011

Related U.S. Application Data

(60) Provisional application No. 61/066,522, filed on Feb. 21, 2008.

(51) Int. Cl.
*A63F 9/24* (2006.01)
*G07F 17/34* (2006.01)

(52) U.S. Cl.
CPC ..... *G07F 17/34* (2013.01); *A63F 2300/695* (2013.01)

(58) Field of Classification Search
CPC ..... G07F 17/34
USPC ..... 463/16–20, 31; 345/87
See application file for complete search history.

(56) References Cited

U.S. PATENT DOCUMENTS 4,764,666 A 8/1988 Bergeron
5,122,643 A 6/1992 Gamou et al.

(Continued)

FOREIGN PATENT DOCUMENTS

WO WO 03/058878 A1 7/2003
WO WO 2004/013820 A2 2/2004
WO WO 2007/089410 A2 8/2007

OTHER PUBLICATIONS

Written Opinion corresponding to co-pending International Patent Application Serial No. PCT/US2009/034519, United States Patent Office; dated Apr. 17, 2009; 5 pages.

(Continued)

*Primary Examiner* — Steve Rowland
(74) *Attorney, Agent, or Firm* — Nixon Peabody LLP

(57) ABSTRACT

A gaming system comprises a wager input device for receiving at least one wager and a display for displaying a wagering game. The display includes an integrated image capture device for visually capturing objects proximate the display. The system further comprises at least one controller operative to (i) detect the presence of at least a first object proximate the display, (ii) cause the image capture device to visually capture the first object and create a stored image thereof, (iii) graphically integrate the stored image of the first object into the wagering game, and (iv) display one or more outcomes of the wagering game which include one or more symbols comprising at least a portion of the stored image.

15 Claims, 9 Drawing Sheets

(56) References Cited

U.S. PATENT DOCUMENTS

| | | | | |
|---|---|---|---|---|
| 5,179,517 | A | 1/1993 | Sarbin et al. | |
| 5,265,874 | A | 11/1993 | Dickinson et al. | |
| 5,287,181 | A | 2/1994 | Holman | |
| 5,340,978 | A * | 8/1994 | Rostoker et al. | 250/208.1 |
| 5,471,044 | A | 11/1995 | Hotta et al. | |
| 5,655,961 | A | 8/1997 | Acres et al. | |
| 5,693,956 | A | 12/1997 | Shi et al. | |
| 5,702,304 | A | 12/1997 | Acres et al. | |
| 5,741,183 | A | 4/1998 | Acres et al. | |
| 5,752,882 | A | 5/1998 | Acres et al. | |
| 5,814,796 | A | 9/1998 | Benson et al. | |
| 5,820,459 | A | 10/1998 | Acres et al. | |
| 5,836,817 | A | 11/1998 | Acres et al. | |
| 5,839,956 | A | 11/1998 | Takemoto | |
| 5,880,769 | A | 3/1999 | Nemirofsky et al. | |
| 5,920,844 | A | 7/1999 | Hotta et al. | |
| 5,941,774 | A | 8/1999 | Takemoto et al. | |
| 5,944,606 | A | 8/1999 | Gerow | |
| 5,951,397 | A | 9/1999 | Dickinson | |
| 5,971,271 | A | 10/1999 | Wynn et al. | |
| 5,988,513 | A | 11/1999 | Dean et al. | |
| 6,013,345 | A | 1/2000 | Koshida et al. | |
| 6,019,284 | A | 2/2000 | Freeman et al. | |
| 6,028,581 | A | 2/2000 | Umeya | |
| 6,135,884 | A | 10/2000 | Hedrick et al. | |
| 6,152,620 | A | 11/2000 | Ozawa et al. | |
| 6,174,836 | B1 | 1/2001 | Hotta et al. | |
| 6,251,014 | B1 | 6/2001 | Stockdale et al. | |
| 6,280,328 | B1 | 8/2001 | Holch et al. | |
| 6,313,856 | B1 | 11/2001 | Ulrich | |
| 6,327,376 | B1 | 12/2001 | Harkin | |
| 6,394,907 | B1 | 5/2002 | Rowe | |
| 6,422,468 | B1 | 7/2002 | Nishizawa et al. | |
| 6,431,453 | B1 | 8/2002 | Hill et al. | |
| 6,431,983 | B2 | 8/2002 | Acres | |
| 6,450,407 | B1 | 9/2002 | Freeman et al. | |
| 6,503,147 | B1 | 1/2003 | Stockdale et al. | |
| 6,517,433 | B2 | 2/2003 | Loose et al. | |
| 6,629,591 | B1 | 10/2003 | Griswold et al. | |
| 6,675,152 | B1 | 1/2004 | Prasad et al. | |
| 6,682,421 | B1 | 1/2004 | Rowe et al. | |
| 6,712,698 | B2 | 3/2004 | Paulsen et al. | |
| 6,745,944 | B2 | 6/2004 | Dell | |
| 6,769,986 | B2 | 8/2004 | Vancura | |
| 6,800,030 | B2 | 10/2004 | Acres | |
| 6,825,692 | B1 | 11/2004 | Chung et al. | |
| 6,831,710 | B2 | 12/2004 | Den Boer | |
| 6,852,031 | B1 | 2/2005 | Rowe | |
| 6,905,411 | B2 | 6/2005 | Nguyen et al. | |
| RE38,812 | E | 10/2005 | Acres et al. | |
| 7,027,056 | B2 | 4/2006 | Koselj et al. | |
| 7,046,282 | B1 * | 5/2006 | Zhang et al. | 348/294 |
| 7,088,326 | B2 | 8/2006 | Lin et al. | |
| 7,119,759 | B2 | 10/2006 | Zehner et al. | |
| 7,128,482 | B2 | 10/2006 | Meyerhofer et al. | |
| 7,192,208 | B2 | 3/2007 | Meyerhofer | |
| 7,240,023 | B1 | 7/2007 | Powell | |
| 7,267,614 | B1 | 9/2007 | Jorasch et al. | |
| 7,287,695 | B2 | 10/2007 | Wankmueller | |
| 7,329,186 | B2 | 2/2008 | Griswold et al. | |
| 7,611,411 | B2 | 11/2009 | Griswold et al. | |
| 2002/0167500 | A1 | 11/2002 | Gelbman | |
| 2002/0173354 | A1 | 11/2002 | Winans et al. | |
| 2003/0022710 | A1 * | 1/2003 | DeMar et al. | 463/16 |
| 2003/0036425 | A1 | 2/2003 | Kaminkow et al. | |
| 2003/0064812 | A1 | 4/2003 | Rappaport et al. | |
| 2003/0078094 | A1 | 4/2003 | Gatto et al. | |
| 2003/0083132 | A1 | 5/2003 | Berg et al. | |
| 2003/0162591 | A1 | 8/2003 | Nguyen et al. | |
| 2003/0162593 | A1 | 8/2003 | Griswold | |
| 2003/0171145 | A1 | 9/2003 | Rowe | |
| 2003/0199312 | A1 | 10/2003 | Walker et al. | |
| 2004/0043813 | A1 | 3/2004 | Chamberlain et al. | |
| 2004/0053692 | A1 | 3/2004 | Chatigny et al. | |
| 2004/0087355 | A1 * | 5/2004 | Toyoda | 463/16 |
| 2004/0087360 | A1 | 5/2004 | Chamberlain et al. | |
| 2004/0136764 | A1 | 7/2004 | Meyerhofer et al. | |
| 2004/0192438 | A1 | 9/2004 | Wells et al. | |
| 2004/0192442 | A1 | 9/2004 | Wells et al. | |
| 2004/0204233 | A1 | 10/2004 | Saffari et al. | |
| 2004/0209674 | A1 | 10/2004 | Conover et al. | |
| 2004/0233930 | A1 | 11/2004 | Colby, Jr. | |
| 2005/0077995 | A1 | 4/2005 | Paulsen et al. | |
| 2005/0085293 | A1 | 4/2005 | Lindo | |
| 2005/0090308 | A1 | 4/2005 | Weiss | |
| 2005/0137005 | A1 | 6/2005 | Soltys et al. | |
| 2005/0240778 | A1 | 10/2005 | Saito | |
| 2005/0282626 | A1 | 12/2005 | Manfredi et al. | |
| 2006/0000891 | A1 | 1/2006 | Bonalle et al. | |
| 2006/0000892 | A1 | 1/2006 | Bonalle et al. | |
| 2006/0000893 | A1 | 1/2006 | Bonalle et al. | |
| 2006/0000894 | A1 | 1/2006 | Bonalle et al. | |
| 2006/0000895 | A1 | 1/2006 | Bonalle et al. | |
| 2006/0016884 | A1 | 1/2006 | Block et al. | |
| 2006/0019745 | A1 | 1/2006 | Benbrahim | |
| 2006/0019746 | A1 | 1/2006 | Seelig et al. | |
| 2006/0025212 | A1 | 2/2006 | Griswold et al. | |
| 2006/0121981 | A1 | 6/2006 | Pfennighausen et al. | |
| 2007/0021191 | A1 | 1/2007 | White et al. | |
| 2007/0032295 | A1 | 2/2007 | Muir et al. | |
| 2008/0106628 | A1 * | 5/2008 | Cok et al. | 348/333.01 |
| 2009/0011821 | A1 | 1/2009 | Griswold et al. | |
| 2009/0102763 | A1 * | 4/2009 | Border et al. | 345/87 |
| 2009/0163267 | A1 * | 6/2009 | Fine | 463/20 |

OTHER PUBLICATIONS

International Search Report corresponding to co-pending International Patent Application Serial No. PCT/US2009/034519, United States Patent Office; dated Apr. 17, 2009; 2 pages.

JCN Network, Sharp Announces New System LCD with Embedded Optical Sensors; Provides Input Capabilities Including Touch Screen and Scanner Functions; Downloaded from http://www.japancorp.net/Article.Asp?Art_ID=15247, on Nov. 28, 2007 (1 page).

* cited by examiner

GAMING SYSTEM HAVING DISPLAYS WITH INTEGRATED IMAGE CAPTURE CAPABILITIES

CLAIM OF PRIORITY AND CROSS-REFERENCE TO RELATED APPLICATIONS

This application is a U.S. National Phase of International Application No. PCT/US2009/034519, filed on Feb. 19, 2009, which claims the benefit of and priority to U.S. Provisional Patent Application No. 61/066,522, filed on Feb. 21, 2008, both of which are incorporated herein by reference in their entireties.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus, and methods for playing wagering games, and more particularly, to gaming systems having displays with integrated image capture capabilities.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options.

Gaming operators and manufacturers continue to develop gaming system products which have increasing popularity with players. Systems which offer players customization of various options are believed to appeal to players, and developments in customization are ongoing.

SUMMARY OF THE INVENTION

According to one aspect of the present invention, a gaming system comprises a wager input device for receiving at least one wager and a display for displaying a wagering game. The display includes an integrated image capture device for visually capturing objects proximate the display. The system further comprises at least one controller operative to (i) detect the presence of at least a first object proximate the display, (ii) cause the image capture device to visually capture the first object and create a stored image thereof, (iii) graphically integrate the stored image of the first object into the wagering game, and (iv) display one or more outcomes of the wagering game which include one or more symbols comprising at least a portion of the stored image.

According to another aspect of the invention, a method of conducting a wagering game on a gaming system comprises receiving a wager and detecting at least a first object overlying a first display, the first display including an integrated image capture device for scanning objects overlying at least portion of and proximate to the first display. The method further comprises visually capturing the first object via the image capture device and creating a stored image thereof and evaluating one or more graphical criteria of the stored image to assess ability to integrate the first object into the wagering game. The method further comprises creating at least one custom symbol comprising at least a portion of the stored image, and displaying one or more outcomes of the wagering game which include the at least one custom symbol.

According to yet another aspect of the invention, a method of conducting a wagering game on a gaming system comprises scanning at least one player identification element via an optical scanner integrated within a first display of the gaming system, the at least one player identification element associated with at least a first player, and comparing the at least one player identification element with information stored within at least one player profile. If the at least one player identification element matches information stored within the at least one player profile, the method comprises authenticating the first player to play a wagering game. The method further comprises detecting receipt of at least one wager from the first player and displaying at least a portion of the wagering game on the first display.

According to yet another aspect of the invention, a gaming system comprises a wager input device for receiving at least one wager and a first display for displaying a wagering game, the first display including an integrated optical scanner for scanning objects overlying an image capture area of the first display. The system further comprises at least one server storing digital security information thereon, a portable digital security device having a second display thereon, and at least one controller operative to (i) generate and display a digital key on the second display, (ii) detect the digital security device proximate the first display with the second display positioned within the image capture area; (iii) cause the optical scanner to scan the digital key displayed on the second display and create a scanned digital key there from; (iv) compare the scanned digital key with the stored digital security information to either authenticate or reject a user of the digital security device; and (v) if the user is authenticated, permit the user to access the gaming system.

According to yet another aspect of the invention, a method of conducting a wagering game on a gaming system comprises detecting receipt of at least a first wager from a first player, and in response thereto, displaying on at least one display one or more plays of a first wagering game to the first player. The method further comprises, upon the conclusion of a gaming session, printing and providing a ticket to the first player, the ticket including indicia thereon associated with a credit balance belonging to the first player. The method further comprises, upon commencement of a subsequent gaming session, detecting the ticket within a image capture area of a first display and scanning the indicia on the ticket via an optical scanner integrated within the first display. The method further comprises recalling the credit balance associated with the ticket, detecting receipt of at least a second wager deducted from the credit balance, and displaying on the first display one or more plays of a second wagering game.

According to yet another aspect of the invention, one or more computer readable storage media is encoded with instructions for directing a gaming system to perform the above methods.

Additional aspects of the invention will be apparent to those of ordinary skill in the art in view of the detailed description of various embodiments, which is made with reference to the drawings, a brief description of which is provided below.

Figure 1A:
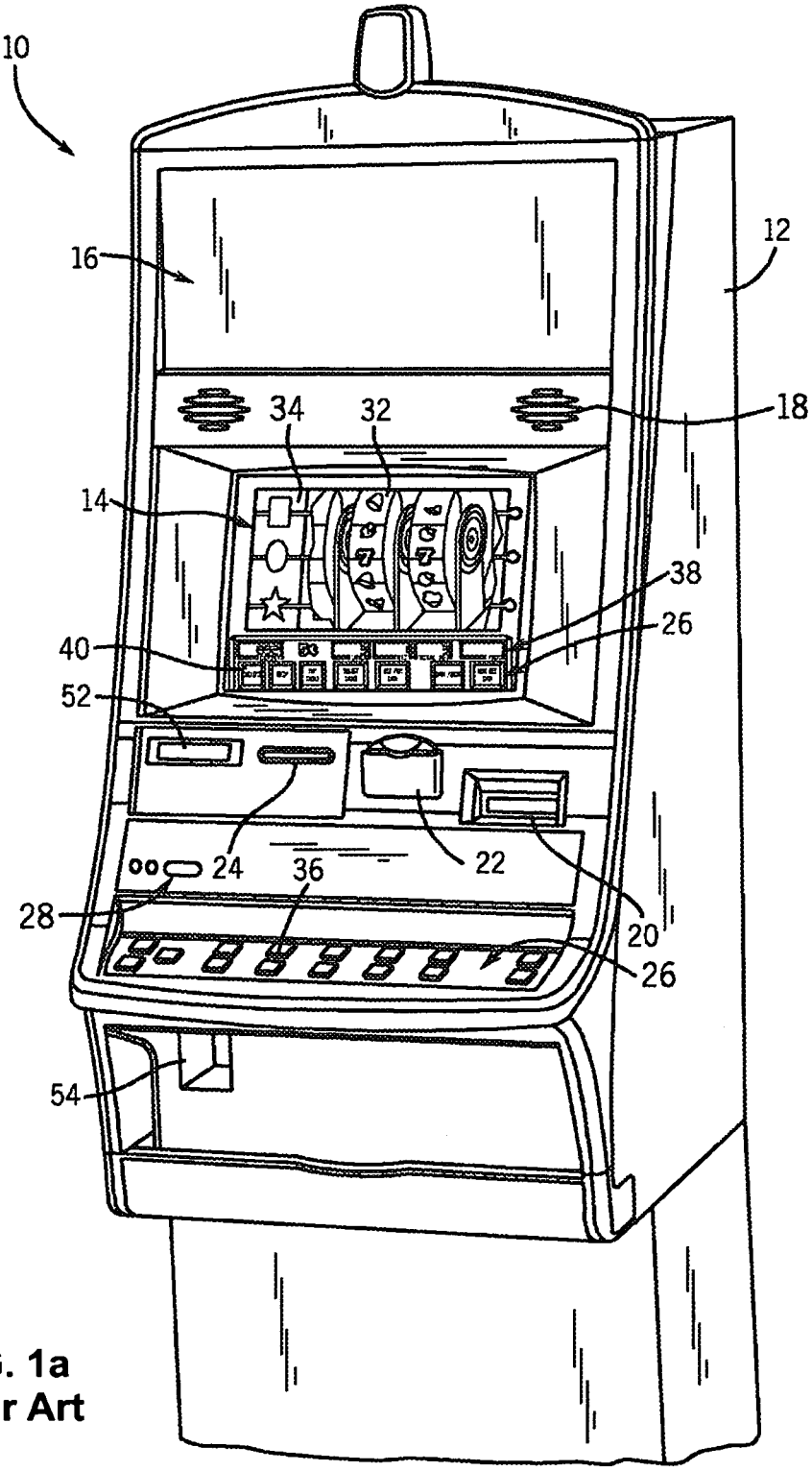
FIG. 1a Prior Art
FIG. 1*a* is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 1B:
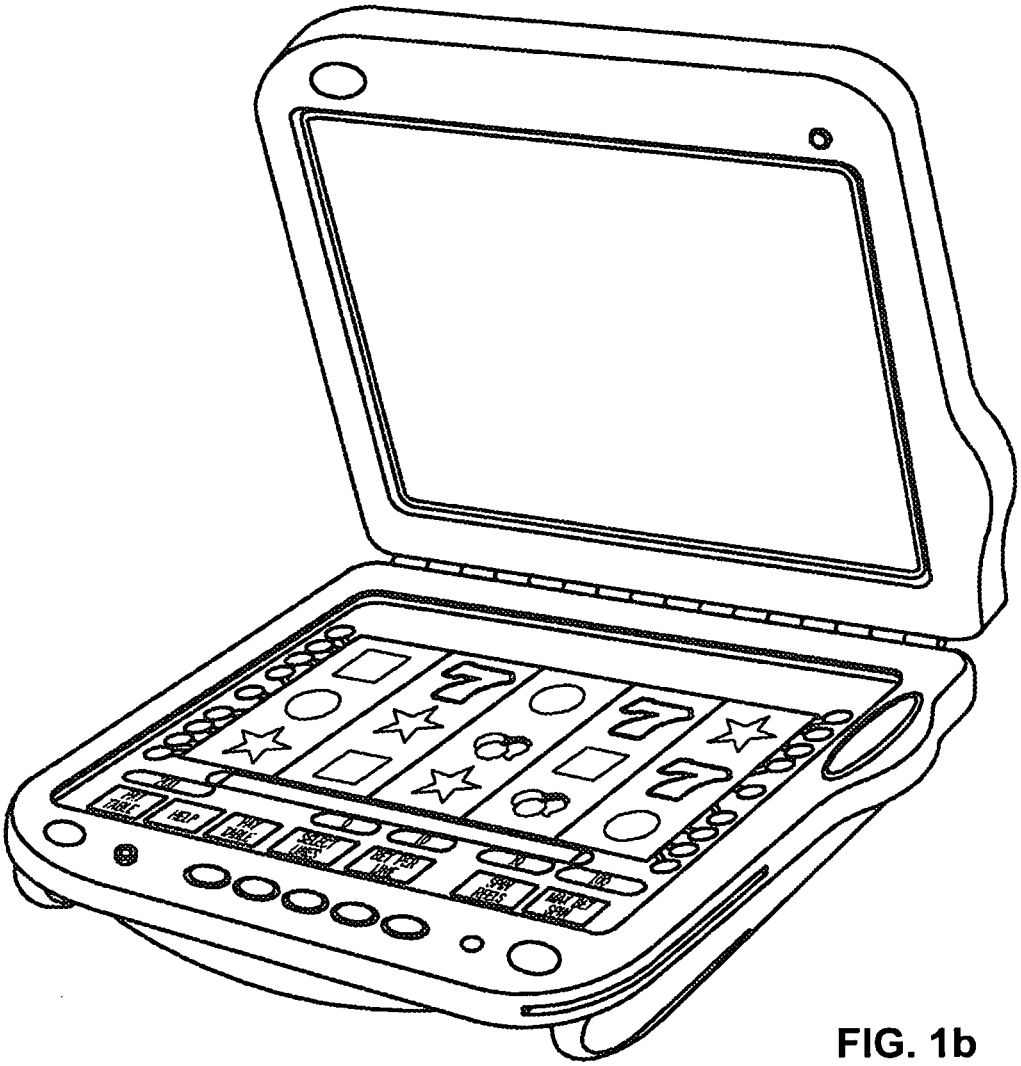
FIG. 1b Prior Art
FIG. 1*b* is a perspective view of a handheld gaming terminal according to an embodiment of the present invention.

Referring to FIG. 1*a*, there is shown a gaming terminal 10 similar to those used in gaming establishments, such as casinos. With regard to the present invention, the gaming terminal 10 may be any type of gaming terminal and may have varying structures and methods of operation. For example, the gaming terminal 10 may be an electromechanical gaming terminal configured to play mechanical slots, or it may be an electronic gaming terminal configured to play a video casino game, such as slots, keno, poker, blackjack, roulette, craps, etc. It should be understood that although the gaming terminal 10 is shown as a free-standing terminal of the upright type, it may take on a wide variety of other forms such as a free-standing terminal of the slant-top type, a portable or handheld device primarily used for gaming as shown in FIG. 1*b*, a mobile telecommunications device such as a mobile telephone or personal digital assistant (PDA), a counter-top or bar-top gaming terminal, or other personal electronic device such as a portable television, MP3 player, entertainment device, etc.

The illustrated gaming terminal 10 comprises a cabinet or housing 12. For output devices, the gaming terminal 10 may include a primary display area 14, a secondary display area 16, and one or more audio speakers 18. The primary display area 14 and/or secondary display area 16 may display information associated with wagering games, non-wagering games, community games, progressives, advertisements, services, premium entertainment, text messaging, emails, alerts or announcements, broadcast information, subscription information, etc. For input devices, the gaming terminal 10 may include a bill validator 20, a coin acceptor 22, one or more information readers 24, one or more player-input devices 26, and one or more player-accessible ports 28 (e.g., an audio output jack for headphones, a video headset jack, a wireless transmitter/receiver, etc.). While these typical components found in the gaming terminal 10 are described below, it should be understood that numerous other peripheral devices and other elements may exist and may be used in any number of combinations to create various forms of a gaming terminal.

The primary display area 14 may include a mechanical-reel display, a video display, or a combination thereof in which a transmissive video display in front of the mechanical-reel display portrays a video image superimposed over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display may be a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10. The primary display area 14 may include one or more paylines 30 (see FIG. 3) extending along a portion thereof. In the illustrated embodiment, the primary display area 14 comprises a plurality of mechanical reels 32 and a video display 34 such as a transmissive display (or a reflected image arrangement in other embodiments) in front of the mechanical reels 32. If the wagering game conducted via the gaming terminal 10 relies upon the video display 34 only and not the mechanical reels 32, the mechanical reels 32 may be removed from the interior of the terminal and the video display 34 may be of a non-transmissive type. Similarly, if the wagering game conducted via the gaming terminal 10 relies upon the mechanical reels 32 but not the video display 34, the video display 34 may be replaced with a conventional glass panel. Further, the underlying mechanical-reel display may be replaced with a video display such that the primary display area 14 includes layered video displays, or may be replaced with another mechanical or physical member such as a mechanical wheel (e.g., a roulette game), dice, a pachinko board, or a diorama presenting a three-dimensional model of a game environment.

Video images in the primary display area 14 and/or the secondary display area 16 may be rendered in two-dimensional (e.g., using Flash Macromedia™) or three-dimensional graphics (e.g., using Renderware™). The images may be played back (e.g., from a recording stored on the gaming terminal 10), streamed (e.g., from a gaming network), or received as a TV signal (e.g., either broadcast or via cable). The images may be animated or they may be real-life images, either prerecorded (e.g., in the case of marketing/promotional material) or as live footage, and the format of the video images may be an analog format, a standard digital format, or a high-definition (HD) digital format.

The player-input devices 26 may include a plurality of buttons 36 on a button panel and/or a touch screen 38 mounted over the primary display area 14 and/or the secondary display area 16 and having one or more soft touch keys 40. The player-input devices 26 may further comprise technologies that do not rely upon touching the gaming terminal, such as speech-recognition technology, gesture-sensing technology, eye-tracking technology, etc. The cabinet 12 of the gaming terminal 10 optionally includes a coin chute 54 for discharging coins to a player resulting, for example, from awards and payouts during play of a wagering game.

The information reader 24 is preferably located on the front of the housing 12 and may take on many forms such as a ticket reader, card reader, bar code scanner, wireless transceiver (e.g., RFID, Bluetooth, etc.), biometric reader, or computer-readable-storage-medium interface. Information may be transmitted between a portable medium (e.g., ticket, voucher, coupon, casino card, smart card, debit card, credit card, etc.) and the information reader 24 for accessing an account associated with cashless gaming, player tracking, game customization, saved-game state, data transfer, and casino services as more fully disclosed in U.S. Patent Publication No. 2003/0045354 entitled "Portable Data Unit for Communicating With Gaming Machine Over Wireless Link," which is incorporated herein by reference in its entirety. The account may be stored at an external system 46 (see FIG. 2) as more fully disclosed in U.S. Pat. No. 6,280,328 to Holch et al. entitled "Cashless Computerized Video Game System and Method," which is incorporated herein by referenced in its entirety, or directly on the portable medium. To enhance security, the individual carrying the portable medium may be required to enter a secondary independent authenticator (e.g., password, PIN number, biometric, etc.) to access their account.

FIG. 1*b* illustrates a portable or handheld device primarily used to display and/or conduct wagering games. The handheld device may incorporate the same features as the gaming terminal 10 or variations thereof. A more detailed description of a handheld device that may be utilized with the present invention can be found in PCT Patent Application No. PCT/US2007/000792 filed Jan. 26, 2007, entitled "Handheld Device for Wagering Games," which is incorporated herein by reference in its entirety.

Figure 2:
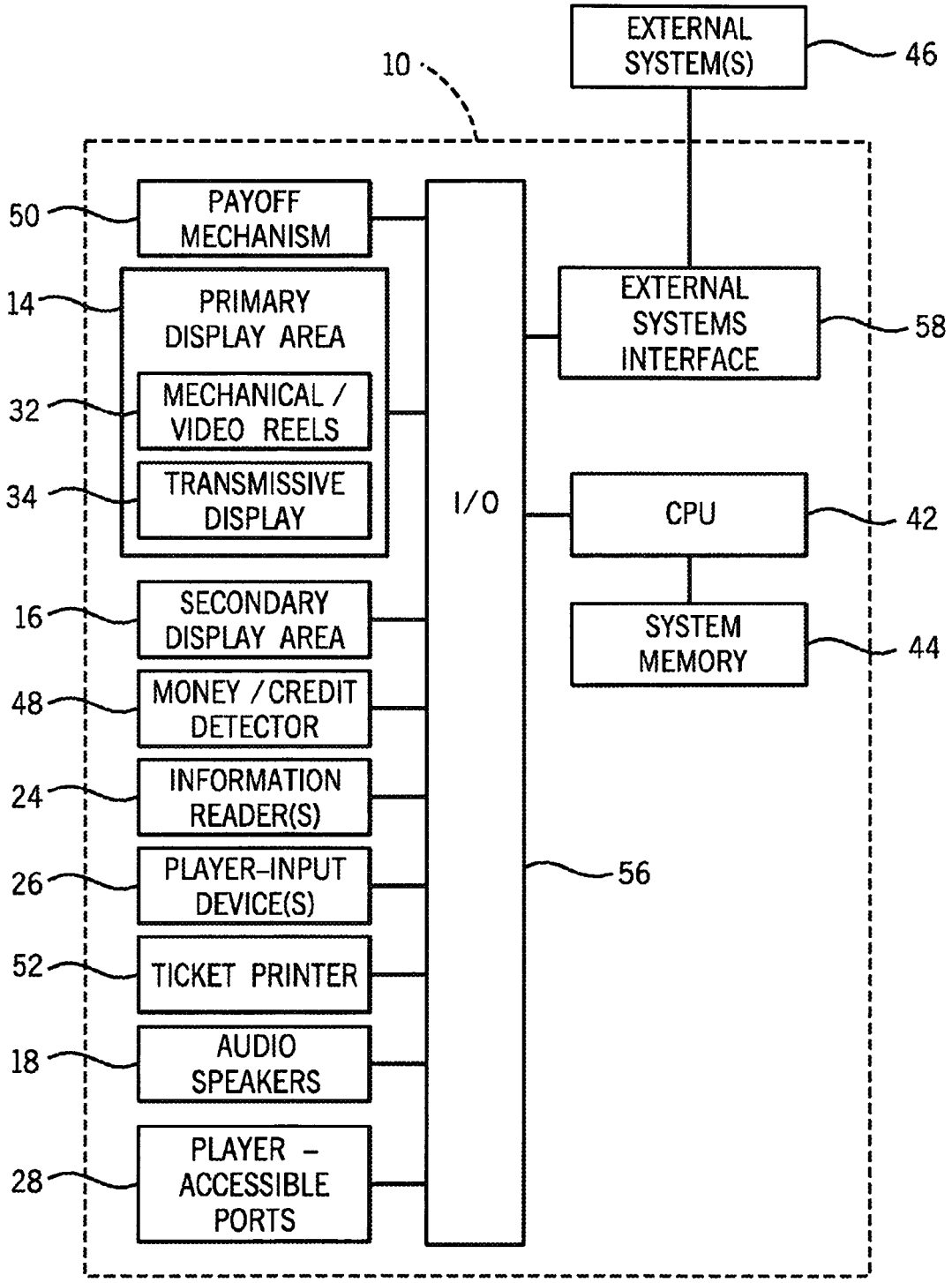
FIG. 2 Prior Art
FIG. 2 is a schematic view of a gaming system according to an embodiment of the present invention.

Turning now to FIG. 2, the various components of the gaming terminal 10 are controlled by a central processing unit (CPU) 42, also referred to herein as a controller or processor (such as a microcontroller or microprocessor). The CPU 42 can include any suitable processor, such as an Intel® Pentium processor, Intel® Core 2 Duo processor, AMD Opteron™ processor, or UltraSPARC® processor. To provide gaming functions, the controller 42 executes one or more game programs stored in one or more computer readable storage media in the form of memory 44 or other suitable storage device. The controller 42 uses a random number generator (RNG) to randomly generate a wagering game outcome from a plurality of possible outcomes. Alternatively, the outcome may be centrally determined using either an RNG or pooling scheme at a remote controller included, for example, within the external system 46. It should be appreciated that the controller 42 may include one or more microprocessors, including but not limited to a master processor, a slave processor, and a secondary or parallel processor.

The controller 42 is coupled to the system memory 44 and also to a money/credit detector 48. The system memory 44 may comprise a volatile memory (e.g., a random-access memory (RAM)) and a non-volatile memory (e.g., an EEPROM). The system memory 44 may include multiple RAM and multiple program memories. The money/credit detector 48 signals the processor that money and/or credits have been input via a value-input device, such as the bill validator 20, coin acceptor 22, or via other sources, such as a cashless gaming account, etc. These components may be located internal or external to the housing 12 of the gaming terminal 10 and connected to the remainder of the components of the gaming terminal 10 via a variety of different wired or wireless connection methods. The money/credit detector 48 detects the input of funds into the gaming terminal 10 (e.g., via currency, electronic funds, ticket, card, etc.) that are generally converted into a credit balance available to the player for wagering on the gaming terminal 10. The credit detector 48 detects when a player places a wager (e.g., via a player-input device 26) to play the wagering game, the wager then generally being deducted from the credit balance. The money/credit detector 48 sends a communication to the controller 42 that a wager has been detected and also communicates the amount of the wager.

As seen in FIG. 2, the controller 42 is also connected to, and controls, the primary display area 14, the player-input device 26, and a payoff mechanism 50. The payoff mechanism 50 is operable in response to instructions from the controller 42 to award a payoff to the player in response to certain winning outcomes that might occur in the base game, the bonus game(s), or via an external game or event. The payoff may be provided in the form of money, redeemable points, services or any combination thereof. Such payoff may be associated with a ticket (from a ticket printer 52), portable data unit (e.g., a card), coins, currency bills, accounts, and the like. The payoff amounts distributed by the payoff mechanism 50 are determined by one or more pay tables stored in the system memory 44.

Communications between the controller 42 and both the peripheral components of the gaming terminal 10 and the external system 46 occur through input/output (I/O) circuit 56, which can include any suitable bus technologies, such as an AGTL+ frontside bus and a PCI backside bus. Although the I/O circuit 56 is shown as a single block, it should be appreciated that the I/O circuit 56 may include a number of different types of I/O circuits. Furthermore, in some embodiments, the components of the gaming terminal 10 can be interconnected according to any suitable interconnection architecture (e.g., directly connected, hypercube, etc.).

The I/O circuit 56 is connected to an external system interface 58, which is connected to the external system 46. The controller 42 communicates with the external system 46 via the external system interface 58 and a communication path (e.g., serial, parallel, IR, RC, 10 bT, etc.). The external system 46 may include a gaming network, other gaming terminals, a gaming server, a remote controller, communications hardware, or a variety of other interfaced systems or components.

Controller 42, as used herein, comprises any combination of hardware, software, and/or firmware that may be disposed or resident inside and/or outside of the gaming terminal 10 and may communicate with and/or control the transfer of data between the gaming terminal 10 and a bus, another computer, processor, or device and/or a service and/or a network. The controller 42 may comprise one or more controllers or processors. In FIG. 2, the controller 42 in the gaming terminal 10 is depicted as comprising a CPU, but the controller 42 may alternatively comprise a CPU in combination with other components, such as the I/O circuit 56 and the system memory 44. The controller 42 is operable to execute all of the various gaming methods and other processes disclosed herein.

The gaming terminal 10 may communicate with external system 46 (in a wired or wireless manner) such that each terminal operates as a "thin client" having relatively less functionality, a "thick client" having relatively more functionality, or with any range of functionality therebetween (e.g., a "rich client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets may be contained within the gaming terminal 10 ("thick client" gaming terminal), the external systems 46 ("thin client" gaming terminal), or distributed therebetween in any suitable manner ("rich client" gaming terminal).

Figure 3:
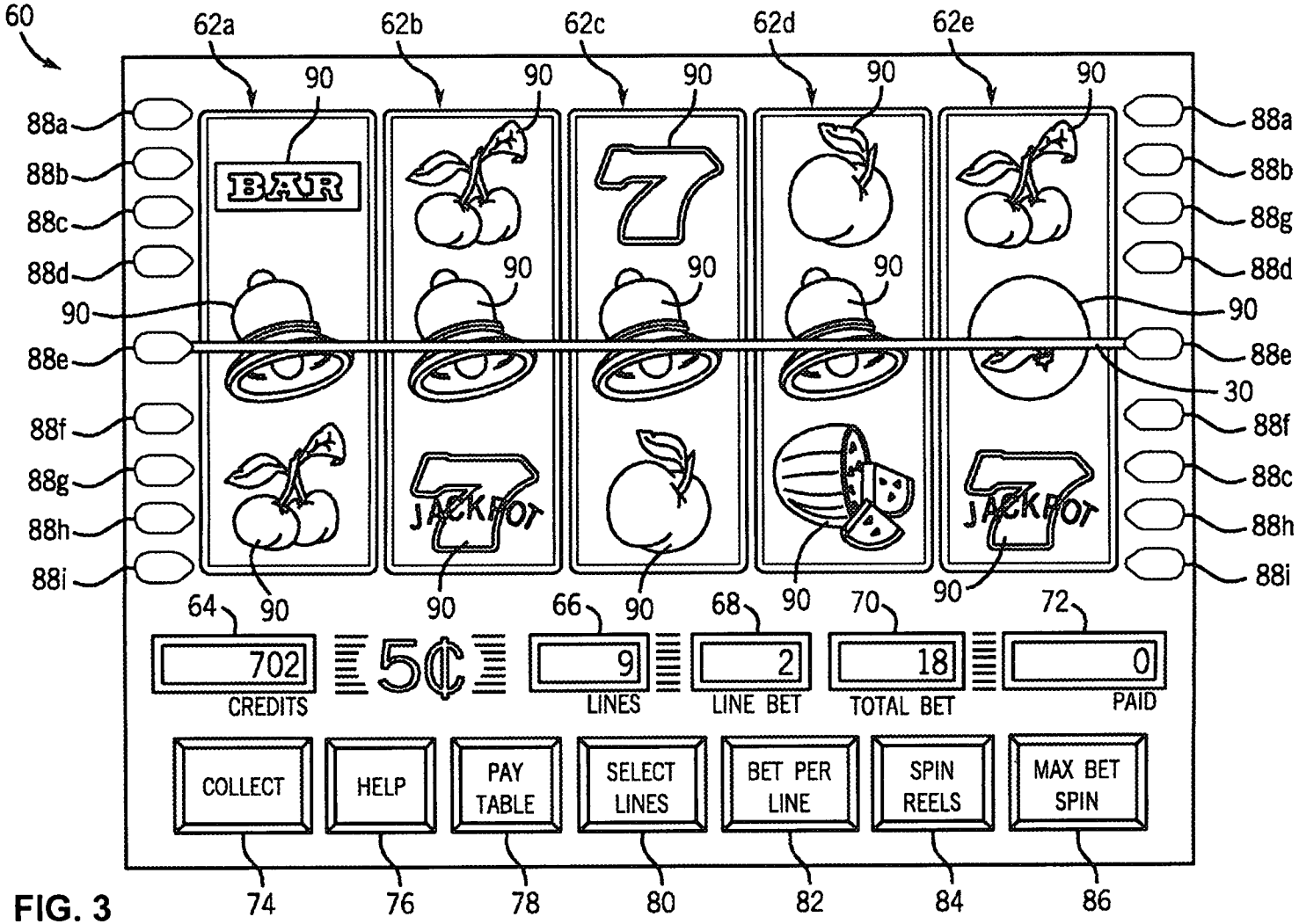
FIG. 3 Prior Art
FIG. 3 is an image of a basic-game screen of a wagering game that may be displayed on a gaming terminal, according to an embodiment of the present invention.

Referring now to FIG. 3, an image of a basic-game screen 60 adapted to be displayed on the primary display area 14 is illustrated, according to one embodiment of the present invention. A player begins play of a basic wagering game by providing a wager. A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

The basic-game screen 60 may be displayed on the primary display area 14 or a portion thereof. In FIG. 3, the basic-game screen 60 portrays a plurality of simulated movable reels 62*a-e*. Alternatively or additionally, the basic-game screen 60 may portray a plurality of mechanical reels. The basic-game screen 60 may also display a plurality of game-session meters and various buttons adapted to be actuated by a player.

In the illustrated embodiment, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The user-selectable buttons may include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager which is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, the present invention does not require them and can be used on gaming terminals having more, less, or different player inputs.

Paylines 30 may extend from one of the payline indicators 88*a-i* on the left side of the basic-game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation or animation, and may further include a "blank" symbol.

Symbol combinations may be evaluated as line pays or scatter pays. Line pays may be evaluated left to right, right to left, top to bottom, bottom to top, or any combination thereof by evaluating the number, type, or order of symbols 90 appearing along an activated payline 30. Scatter pays are evaluated without regard to position or paylines and only require that such combination appears anywhere on the reels 62*a-e*. While an embodiment with nine paylines is shown, a wagering game with no paylines, a single payline, or any plurality of paylines will also work with the present invention. Additionally, though an embodiment with five reels is shown, a gaming terminal with any plurality of reels may also be used in accordance with the present invention.

Figure 4:
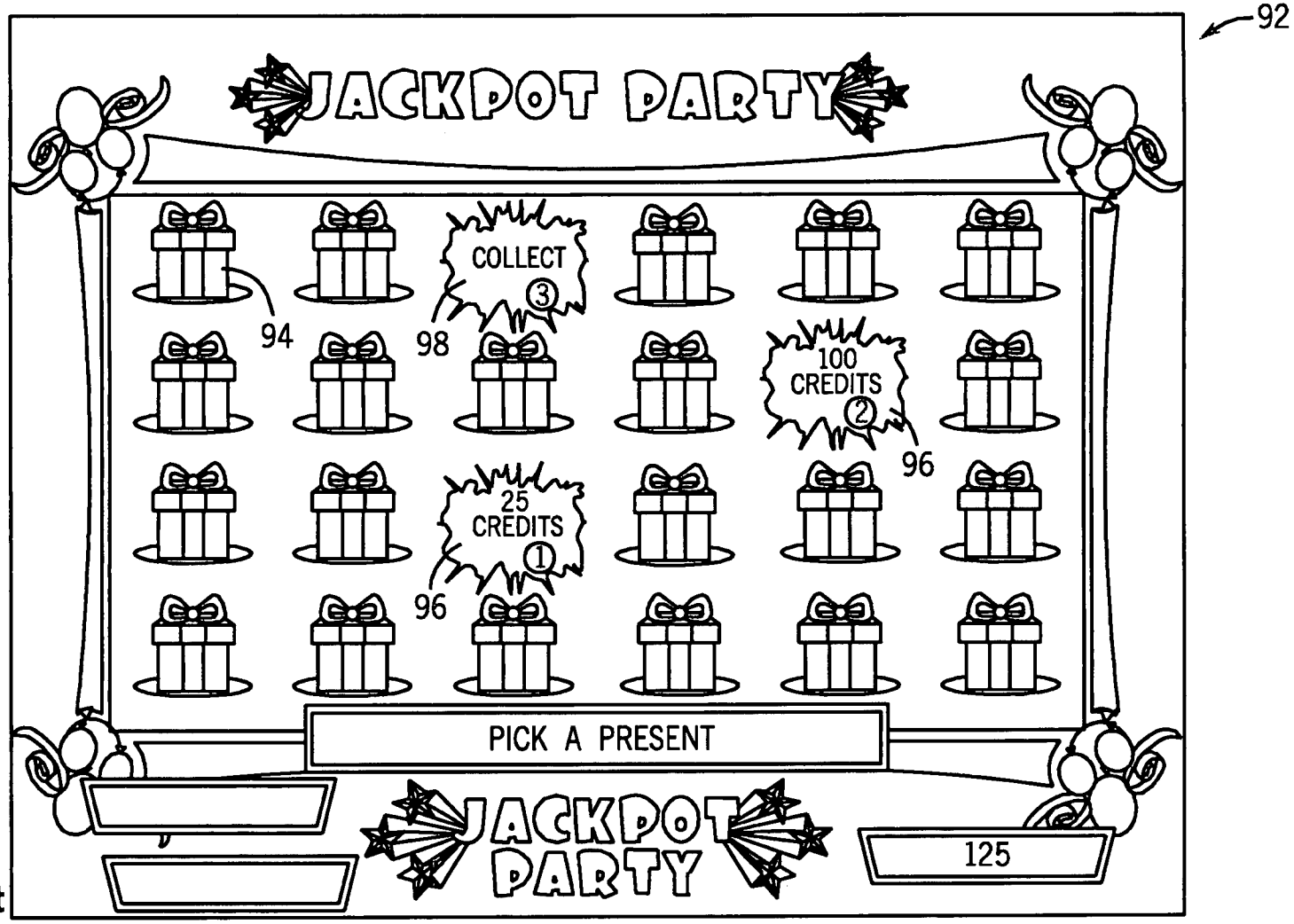
FIG. 4 Prior Art
FIG. 4 is an image of a bonus-game screen of a wagering game that may be displayed on a gaming terminal, according to an embodiment of the present invention.

Turning now to FIG. 4, a bonus game that may be included with a basic wagering game is illustrated, according to one embodiment. A bonus-game screen 92 includes an array of markers 94 located in a plurality of columns and rows. The bonus game may be entered upon the occurrence of a special start-bonus game outcome (e.g., symbol trigger, mystery trigger, time-based trigger, etc.) in or during the basic wagering game. Alternatively, the illustrated game may be a stand-alone wagering game.

In the illustrated bonus game, a player selects, one at a time, from the array of markers 94 to reveal an associated bonus-game outcome. According to one embodiment, each marker 94 in the array is associated with an award outcome 96 (e.g., credits or other non-negative outcomes) or an end-game outcome 98. In the illustrated example, a player has selected an award outcome 96 with the player's first two selections (25 credits and 100 credits, respectively). When one or more end-game outcome 98 is selected (as illustrated by the player's third pick), the bonus game is terminated and the accumulated award outcomes 96 are provided to the player.

Figure 5:
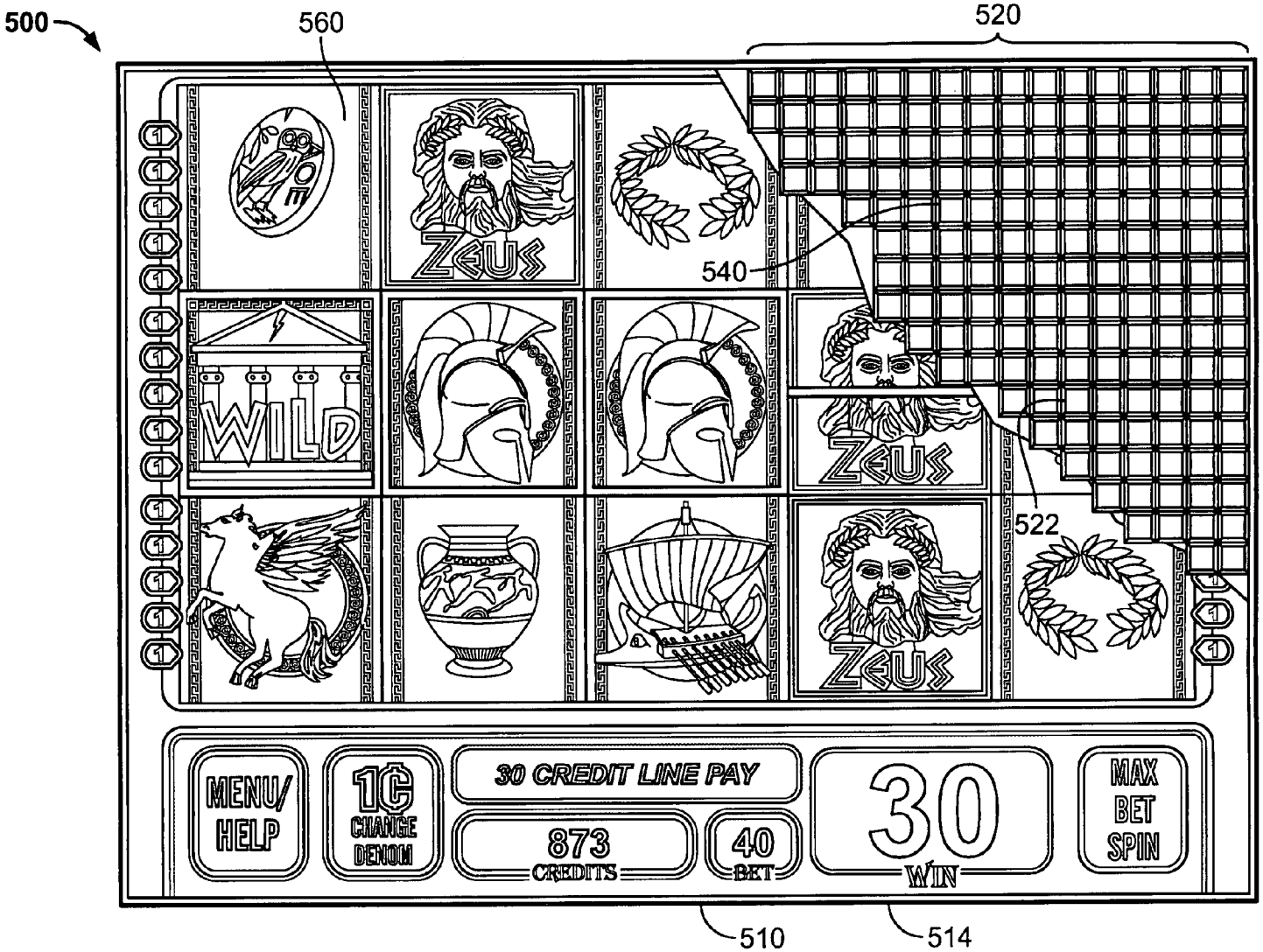
FIG. 5 is an image of a gaming system display having an integrated image capture device.

Referring now to FIG. 5, a primary display 514 of a gaming device 510 of a gaming system 500 is displayed. In the embodiment shown, the primary display 514 is a liquid crystal type display comprising a flat panel display for creating graphical images via a plurality of pixels 522 arranged in a matrix 520 or array (cutaway portion of FIG. 5). The matrix 520 of pixels 522 is arranged so as to comprise a visible area of the display 514, or alternatively, some sub-portion thereof. One or more controllers (not shown) control the pixels 522 of the display 514 so as to display graphical images and information related to the display of one or more wagering games 560 on the gaming system 500. The arrangement of pixels 522 in the matrix 520 may take on a variety of forms. In one embodiment, the matrix 520 is rectangular and comprises a height and width of predetermined numbers of pixels 522. For example, the display 514 may have a screen resolution of 1280×1024, signifying that the display 514 has 1280 pixels 522 across its width and 1024 pixels 522 across its height. Many other configurations and numbers of pixels 522 may be used in configuring the matrix 520 of the display 514.

Figure 6:
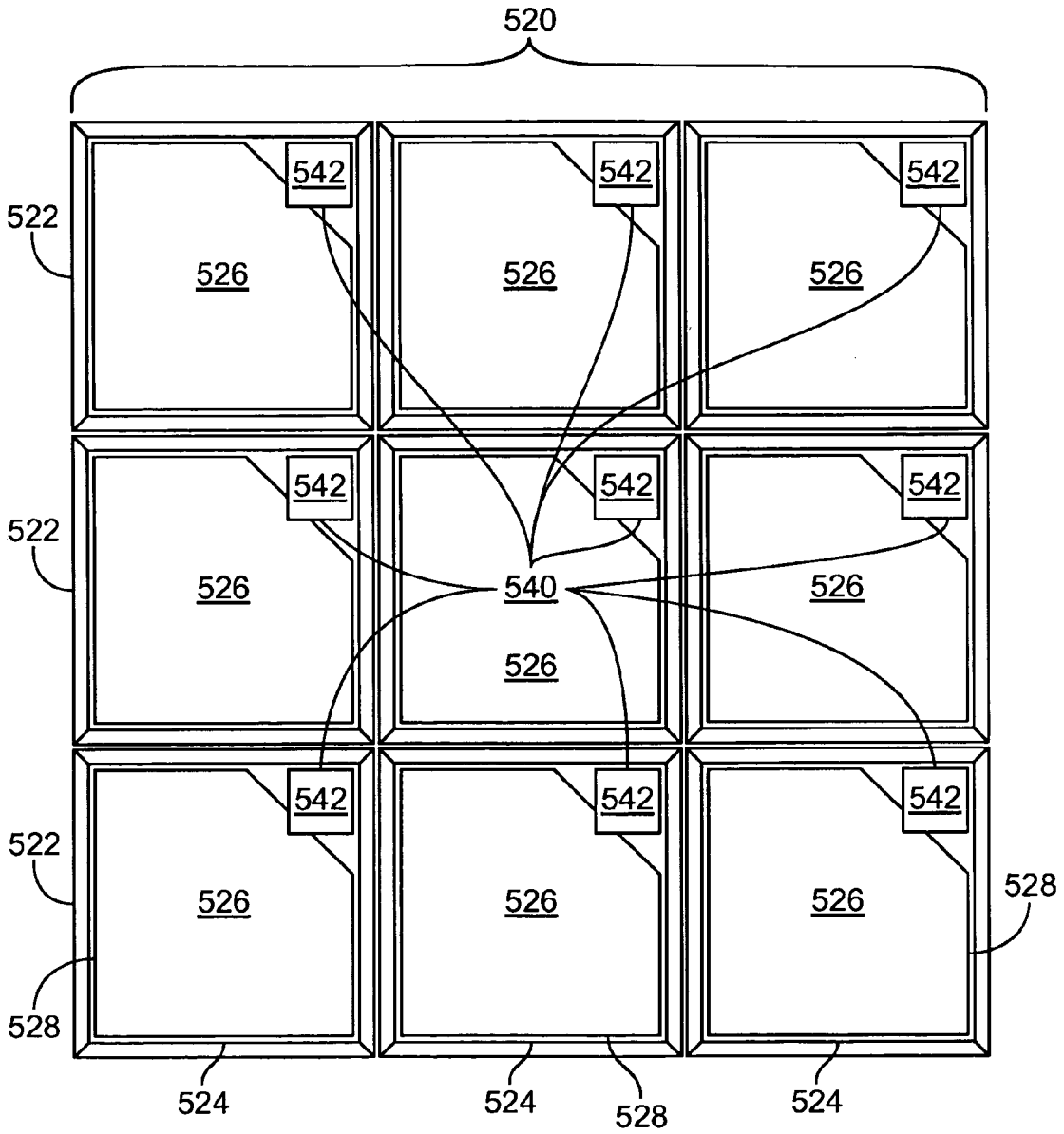
FIG. 6 is a portion of a matrix of pixels comprising the image capture device of FIG. 5.

In an embodiment, as seen in FIGS. 5 and 6, the primary display 514 includes an integrated image capture device 540. In one embodiment, the integrated image capture device 540 comprises one or more input sensors 542 which are positioned and interspersed within the matrix 520 of pixels 522. The input sensors 542 may comprise optical sensors such as photo-optical sensors, photodiodes, or other sensors, as described herein. The configuration of the input sensors 542 within the matrix 520 of pixels 522 may take on many forms. In the embodiment shown in the FIGURES, the primary display 514 includes one input sensor 542 for each pixel 522 within the matrix 520. In other embodiments, multiple input sensors 542 may be used within each pixel 522. Moreover, in yet other embodiments, not every pixel 522 within the matrix 520 need be outfitted with an input sensor 542. In other words, some subset of pixels 522 may be designated as an input area of the display 514, and the input sensors 542 may be confined to the pixels 522 within the input area.

Turning to FIG. 6, a view of a portion of the matrix 520 of pixels 522 is displayed showing details of an arrangement of input sensors 542 within each pixel 522. An example of nine pixels 522 selected from the matrix 520 is shown. Each pixel 522 includes a perimeter 524 within which are located an output source 526 and a corresponding input sensor 542. In one embodiment, the output source 526 comprises a transparent electrode 528 which is controlled by a transistor, such as a thin film transistor (TFT). The transistor may act as a switch to control voltage applied to the transparent electrode 528, which in turn causes the transparent electrode 528 to adjust its opacity to control the display of the associated pixel 522. Thus, by varying the voltage applied, the opacity of the transparent electrode 528 is adjusted to control the light passing through the pixel 522 so as to create a graphical image, as is known with liquid crystal displays. The pixels 522 may be configured to display images in black and white (grayscale) or alternatively in color using various color layers of electrodes 528, which when adjusted and controlled may be used to produce different colors within different pixels 522.

The input sensors 542 within each pixel 522 shown in FIG. 6 may sense a variety of inputs via the display 514. For example, the input sensors 542 may be configured to be surface scanning optical sensors such that an object, document, or other item placed on the surface of the display 514 can be captured and stored. In such a configuration, the input sensors 542 act in cooperation as an optical scanner input. In another embodiment, the input sensors 542 may include micro-lenses such that objects in front of the display 514 (but not necessarily touching it) may be digitally captured and stored. In such a configuration the input sensors 542, through micro-lenses, act as cameras which capture images or portions thereof which may be stored in memory. The input sensors 542 may be configured in a manner so as to capture images within a certain range of distances from the display 514, for example from five centimeters to fifty centimeters from the front surface of the display 514. The input sensors 542 may each be configured to capture a portion of an overall image which is then created and stored in memory by assembling the image portions captured by each individual sensor 542.

One example of a liquid crystal display having such input sensors and capabilities is disclosed in U.S. Pat. No. 6,028,581 to Umeya, which is hereby incorporated in its entirety as if fully set forth herein. Another example of a liquid crystal display having optical scanning and image capture capabilities is known as the System LCD which is manufactured by Sharp Corporation of Osaka, Japan. More information on System LCD can be found on the internet at http://sharp-world.com/corporate/news/070831.html which is hereby incorporated herein in its entirety as if fully set forth herein.

Figure 7:
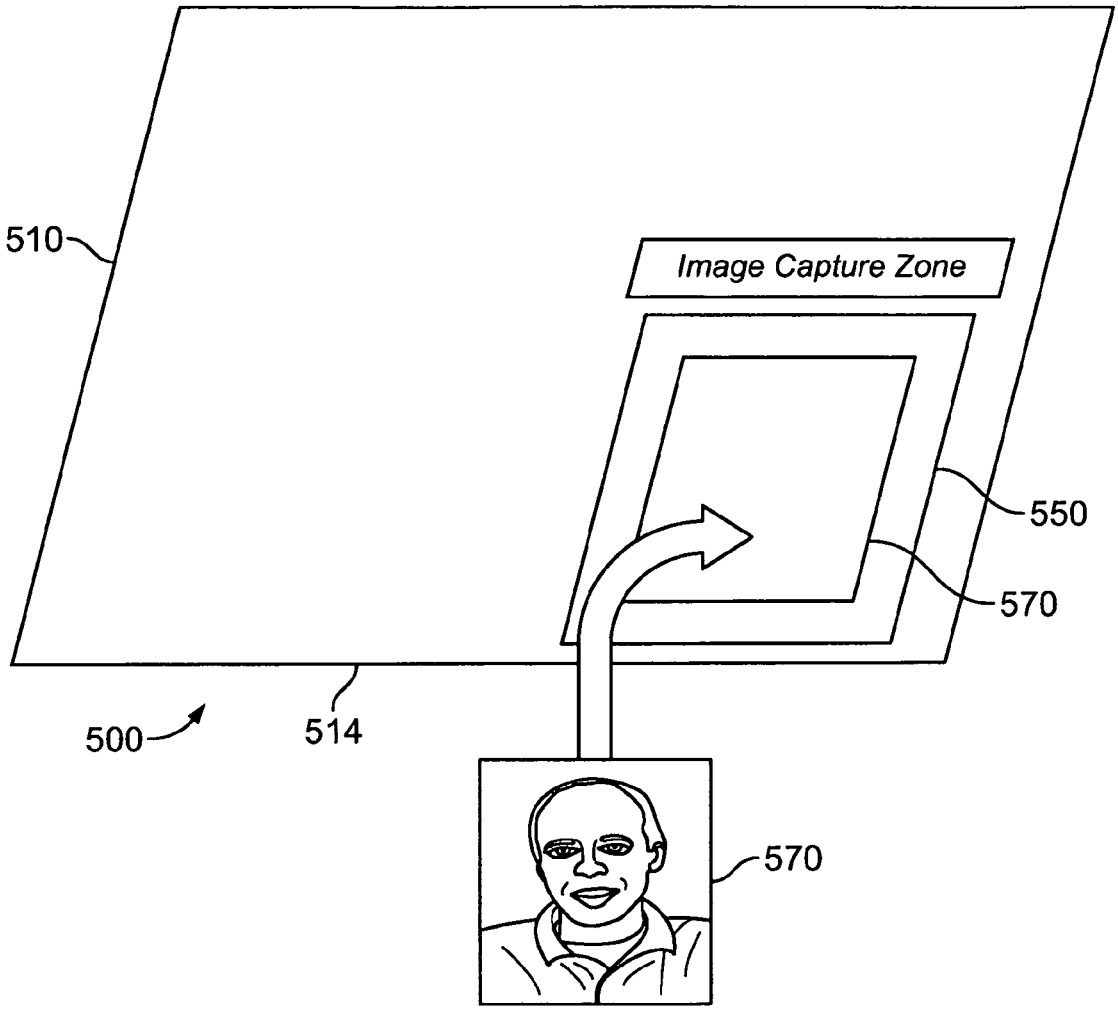
FIG. 7 is an image of the display and image capture device of FIG. 5 in use visually capturing an object.

The image capture device 540 integrated within the display 514 provides a number of benefits when used within a gaming device. In one example, shown in FIG. 7, the display 514 may have a designated image capture area 550 which may be communicated to a player or user of the gaming system 500 via the output of the display 514. For example, in FIG. 7 the image capture area 550 is highlighted with an outlined border and the words "Image Capture Zone" to indicate to the player that objects or documents to be scanned or captured should be placed within the image capture area 550. A player then may take an object 570 such as a personal photograph, driver's license, player card, or other item and place it within the image capture area 550 in response to prompts from the gaming system 500. One or more of the input sensors 542 within the image capture area 550 may be used to detect placement of the object 570, and a controller may then cause the image capture process to begin. In the example in FIG. 7, once the player's photograph 570 is placed within the image capture area 550, it is scanned and stored digitally in memory or other storage devices of the gaming system 500.

Figure 8:
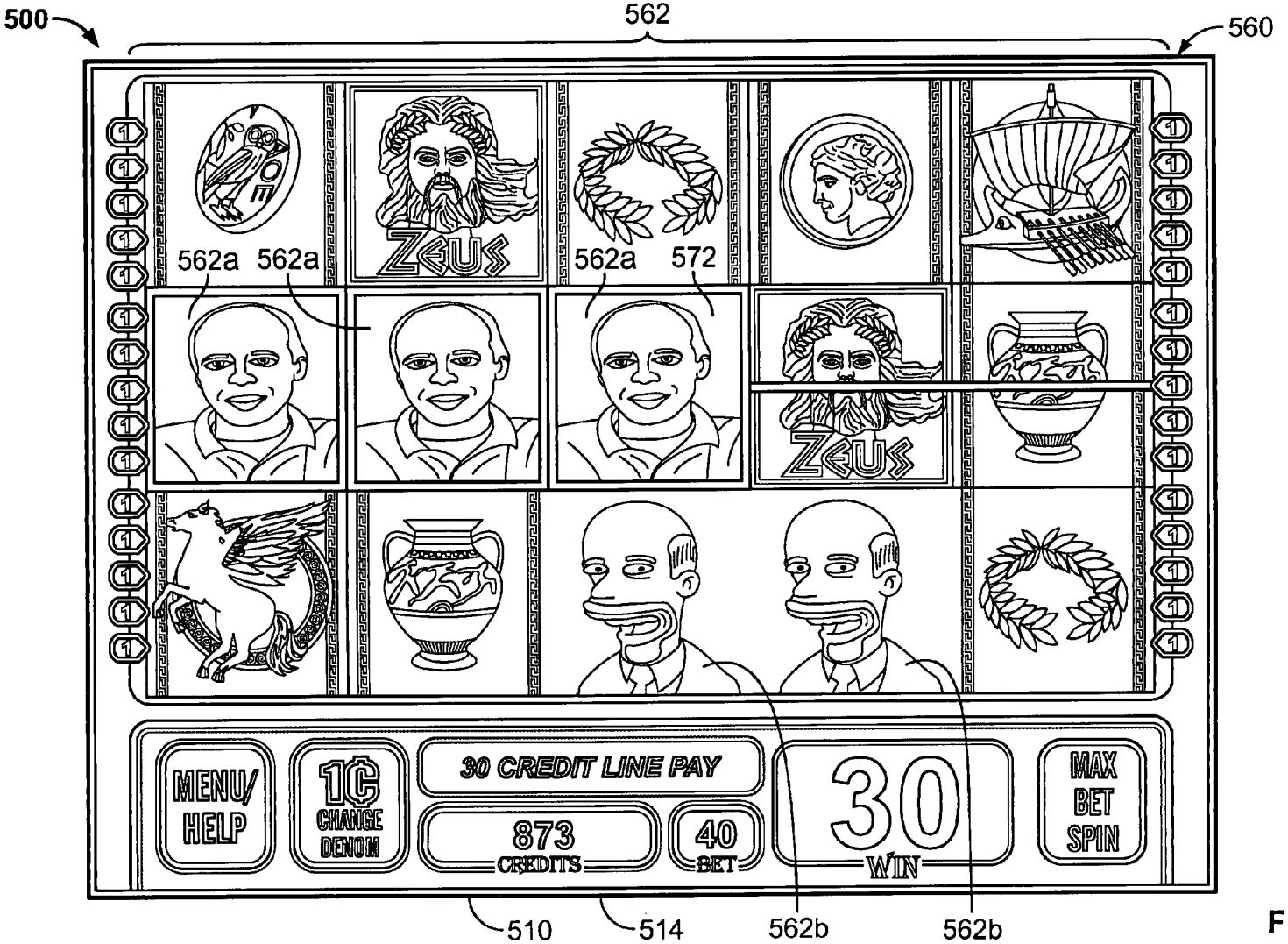
FIG. 8 is an image of a portion of a wagering game utilizing a stored image received via the image capture device.

Once a digital image of a scanned object 570 is scanned, captured and stored, it may be used by the gaming system 500 for a variety of applications. In one such example, as seen in FIG. 8, the personal photograph 570 of the player has been scanned and a stored image 572 comprises a digital image or copy of the photograph 570 or some portion thereof. Thus, in this example, the stored image 572 comprises an image of the player's likeness. The stored image 572 may be used within the wagering game 560 in many ways. For example, the stored image 572 may be used to replace one or more symbols 562 of the wagering game 560, as seen in FIG. 8. In this embodiment, one of the symbols has been replaced by the stored image 572 (player's likeness). Thus as the slot game is played, the player will have a customized gaming experience by being able to view his likeness (stored image 572) within the set of symbols 562 displayed on the display 514. As seen in FIG. 8, three of the player's likeness symbols 562 have aligned on an active payline to provide the player a winning outcome for which an award is received.

The stored image 572 may also be analyzed by the gaming system 500 so as to provide customization to various features of the wagering game 560 displayed, or to other ancillary services provided on the system 500. For example, by scanning in a player's driver's license, the picture therein may be evaluated and analyzed for certain features. In one example, if the hair on the driver's license photograph is gray or white, the volume of the gaming system may be adjusted upward. Symbols or other gaming assets of the gaming system may be customized with the captured image, including reel symbols, backgrounds, avatars, button images, icons, and other customizable areas of the display 514 screen. Moreover, dynamic electro-mechanical buttons, such as buttons having LCD, LED, or OLED displays thereon, may be customized using graphics from the captured images.

Furthermore, the image capturing process may be used, for example, to capture biometric information or data for security or other purposes. The image capture area 550 of the display 514 may be used to scan a finger print of a player, and in response thereto, a player account may be accessed, verified, and used to fund play on the gaming system 500. The finger print scanned image may also be used for other security purposes, or to identify players for any number of customization and promotional uses. Other biometric data may be captured by the image capture device 540 as well, such as retinal scanning, facial scanning, and identification card scanning. Moreover, identification cards may be received and processed via the image capture device 540. Identification of individuals may be used for players, service technicians, casino operators, manufacturer personnel, gaming regulators, and various other groups (and sub-groups) of people, with each such group receiving access to various content on the gaming system 500. For example, technicians may receive access to configuration screens on the display 500 once their identity is authenticated via the image capture area 550. Regulator may be given access to accounting and configuration data as well. Operators may be given the broadest level of access to monitor performance of the gaming system 500, while player's access may be substantially more limited. Numerous customization techniques may be used to restrict access to the system based upon characteristics associated with an identified authorized user of the system 500. Thus, the system 500 may be configured to detect a role associated with the user accessing the system 500, and to provide the user with access to portions of the system commensurate with that person's role.

Alternatively, the image capture device 540 may be used with a portable digital security device (not shown). A player may be issued a key fob or other portable device which generates a security "key" which could be displayed on a display of the portable device in the form of a number, a string of characters, or even a graphical image. The player may interface the portable security device by placing the display of the portable security device in proximity with or adjacent to the image capture area 550 of the system 500. Once in place, the image capture device 540 may be used to read and capture the security key generated and displayed on the portable security device. The stored image captured by the image capture device 540 may then be compared against various security codes and files stored in memory of the system 500. A match would authenticate the player as an authorized user of the system 500 and permit play to begin. For higher security applications, a series of images may be loaded.

The image capture device 540 may further be used to capture dynamic inputs. In one embodiment, the image capture device 540 may replace and eliminate the need for a traditional touch screen apparatus overlying the display 514. Inputs can be received via the input sensors 542 of the image capture device 540 rather than via the touch screen. By eliminating the touch screen, the clarity and brightness of the displayed images is improved due to the removal of the extra layer of touch screen overlying the display 514. The image capture device 540 may also sense inputs which are dynamic, such as capturing gestures or movement in front of or along the surface of the display 514. A player may drag his finger along the surface of the display 514 and such dynamic input can be sensed and interpreted by the input sensors 542 of the image capture device 540. Moreover, the image capture area 550 may be used such that a player may draw images with his finger, a stylus, or other input device. A player may also be permitted to "draw in" other features or elements on the display 514 which can be incorporated in the wagering game 560. For example, a player may be permitted to draw in a customized payline passing through certain symbol positions within the wagering game 560. Yet another benefit provided by the input sensors 542 is the ability for a player (or multiple players) to provide multiple inputs on the display 514 simultaneously.

The objects 570 which are captured by the image capture device 540 may also vary greatly in nature and application. For example, casino operators and gaming manufacturers may provide players with promotions, incentives and awards in the form of coupons, vouchers, cards, figurines, etc. The image capture device 540, as part of the gaming system 500, may be used to "redeem" awards associated with such promotional items. For example, a player bearing a coupon may place the coupon in the image capture area 550 of the display 514 and the coupon may then be scanned or captured by the image capture device 540. Once the coupon is scanned and a stored image 572 is created, the "value" associated with the coupon may be processed by the gaming system 500 and awarded to the player or otherwise applied to the player's account or wagering game. The coupon or voucher used may include identifiers, such as a bar code or alphanumeric identifier, which may be utilized in the redemption process to authenticate the coupon or voucher. In this way, the image capture device 540 may be used to validate coupons, and may replace or supplement other devices and peripherals used for these purposes, such as bill validators or coupon readers.

In addition to coupons, game cards may be used in which player's receive game cards or tokens which possess or associated with certain assets or attributes usable during play of various wagering games. For example, player's characters or other characters within a wagering game may have associated attributes such as strength, armor, dexterity, intelligence, etc., which can be increased, modified or adjusted by players through the collection of and interfacing of game cards associated with such attributes. The image capture device 540 may be used to redeem such game cards and use the allocated attributes thereon to modify wagering game assets. One such gaming system which includes game cards associated with wagering game attributes and assets is disclosed and published in PCT Application, International Publication Number WO 2007/098117 to Anderson et. al. and assigned to WMS Gaming Inc., which is hereby incorporated in its entirety as if fully set forth herein.

Moreover, the information received via the image capture device 540 may be utilized in a variety of manners and processed by the gaming system 500. For example, various optical character recognition techniques and methods may be employed on the gaming system 500 to read and process alphanumeric data contained on the object 570 which was scanned and captured visually by the image capture device 540. Identification cards, drivers licenses, and other data containing documents may be "read" via the image capture device 540 and "translated" or processed by the gaming system 500 using OCR and other techniques. In this way, text, numbers, or other data which is documented or displayed on objects may be input via the image capture device 540. In one application, authentication of player identification (for example scanning a player's driver's license) may be used as a rapid identifier for tax purposes. For awards and payouts of certain amounts for which authentication is desirable or required, confirmation of the person's identify via the image capture device 540 may be used instead of slower manual techniques, such as a casino operator employee manually paying the award to the player.

The stored image 572 received via the image capture device 540 may be used for a variety of purposes. In one example, the player may provide inputs, for example, by selecting keno numbers on a keno card and scanning the card via the image capture device 540. Alternatively, "mystery" cards may be given or issued to players who may use the image capture device 540 to "reveal" the contents of the card, by scanning in the card and having the display 514 depict the concealed contents. Moreover, the input received via the image capture device 540 may be used as a starting point or "seed" for a random number generator operating one or more wagering game outcomes. For example, a player may be prompted to select one or more numbers from an array of numbers (as in a Keno game) and the selected numbers may be the starting point from which the random number generator performs a randomly selected outcome. This gives the player a feeling of control without compromising the random aspect of the selected outcomes.

In addition to using a stored image 572 in the form in which it was captured, the stored image 572 may be modified, adjusted, or amended to create a modified stored image which is then used in displaying the wagering game 560 or portions thereof. For example, a person's likeness may be captured, as described herein, and then animated or caricaturized in accordance with a theme of the wagering game 560. In one example, if the wagering game 560 involves a Greek mythology theme, as seen in FIG. 8, the player's stored image 572 may be modified such that the player resembles a Greek god in the modified stored image, as opposed to simply displaying the version of the image as captured. In other examples, other portions of the stored image 572 may be modified, including aspect ratios, colors, orientations, animations, etc.

In a configuration where the image sensors 542 act as a camera to capture images of objects placed apart from the surface of the display 514, the integrated image capture device 540 provides benefits over separate image capture devices. For example, a camera placed on the gaming device so as to be above, below, next to or otherwise proximate the display causes a player to turn off-axis from the center of the display and thus creates problems in attempting image captures. A player looking off axis (into the camera lens for example) may be forced to take multiple pictures before he or she is satisfied with the captured image. This detracts from game play by needlessly wasting time in obtaining a satisfactory image capture, and thus results in lost revenue to the gaming system operator. The integrated image capture device 542 could prompt a player to look directly at the center of the display 514, eliminating or reducing chances that the player's image will be off-axis, askew, or otherwise undesirable. This in turn will result in fewer image capture attempts and more time spent playing the wagering game on the system, which is beneficial to player and operator alike.

One such modification which may be performed on a stored image is an animation or caricaturizing of the scanned object 570 or image, and creation of a modified version of the image which is enhanced. As used herein, a "caricature" is meant to be a portrait or visual likeness that exaggerates or distorts the essence of a person or thing to create an easily identifiable visual likeness. Caricatures can be insulting or complimentary and can serve a political purpose or be drawn solely for entertainment. For example, caricatures of politicians are commonly used in editorial cartoons, while caricatures of movie stars are often found in entertainment magazines. In wagering games, caricatures may be used as symbols, backgrounds, or other graphics or aspects of wagering game, and can include caricatures of celebrities, politicians, thematically related characters, or even players themselves (or their friends, family, etc.).

The gaming system 500 may further include software and processing for automatically or semi-automatically generating a caricature. In one example, caricaturization software may be applied to edit or modify a scanned image. Thus, a player may input an image of himself, his friends, family, or a celebrity, politician, or other person into the gaming system 500 using the image capture device 540. For example, the player may scan a photograph of himself. Once the scanned image 572 is received, caricaturization software may amend and modify the image to create a caricature having exaggerated features, colors, etc. One example of caricaturization software can be found at www.simpsonizeme.com which is a website in which an individual can upload a picture which is analyzed and converted into a caricature. Other caricaturization software may be utilized as well. An example of a caricaturized image is seen in FIG. 8, where symbol 562*b* is a caricaturized version of scanned image symbol 562*a*.

The gaming system and methods disclosed herein offer significant advancements and advantages to players and operators alike. By providing an input device via the image capture device integrated with the display, game play may be enhanced and customized. Moreover, the image capture device may replace or augment existing input devices such as a touch screen overlying the display. The image capture device allows for improved methods of input including motion capture, gesture capture, and multiple touch inputs. Moreover, the image capture device may be used in a variety of manners to improve security of the gaming system, including various aspects of authentication as described.

Each of these embodiments and obvious variations thereof is contemplated as falling within the spirit and scope of the claimed invention, which is set forth in the following claims.

What is claimed is:

1. A gaming system comprising:

a wager input device configured to receive at least one wager;

a display configured to display a wagering game, the display including an array of pixels, a video display device with a plurality of light output sources, and an image capture device with a plurality of optical sensors, each of the pixels being integrally formed with at least one of the light output sources and at least one of the optical sensors, the image capture device being configured to optically capture objects proximate the display; and at least one controller operative to:

detect the presence of at least a first object proximate the display, cause the image capture device to optically capture the first object and create a stored image thereof, graphically integrate the stored image of the first object into the wagering game, and cause the video display device to display one or more outcomes of the wagering game which include one or more symbols comprising at least a portion of the stored image.

2. The gaming system of claim 1, wherein the image capture device optically captures portions of the first object that overlay and directly contact the video display device.

3. The gaming system of claim 1, wherein the at least one controller is further operative to detect whether the first object is within a predetermined range of distances from the display.

4. The gaming system of claim 1, wherein the display is further configured to graphically depict an image capture area on the video display device.

5. The gaming system of claim 4, wherein the image capture device lies within the image capture area.

6. A method of conducting a wagering game on a gaming system with an input device and at least one controller, the method comprising:

receiving, via the input device, a wager;

detecting at least a first object overlying a first display, the first display including an array of pixels, a video display device with a plurality of light output sources, and an image capture device with a plurality of optical sensors, each of the pixels being integrally formed with at least one of the light output sources and at least one of the optical sensors, the image capture device being configured to scan portions of the first object proximate to the first display;

optically capturing the first object via the image capture device and creating a stored image thereof;

evaluating, via the at least one controller, one or more graphical criteria of the stored image to assess an ability to integrate the stored image of the first object into the wagering game;

creating at least one custom symbol comprising at least a portion of the stored image; and displaying, via the video display, one or more outcomes of the wagering game which include the at least one custom symbol.

7. The method of claim 6, wherein the image capture device comprises an optical scanner.

8. The method of claim 7, wherein the plurality of optical sensors includes a plurality of surface scanning optical sensors.

9. The method of claim 6, wherein the first display is a liquid crystal display (LCD) device, the plurality of light output sources including a first plurality of transistors operable to output images from the LCD device, and the plurality of optical sensors including a second plurality of transistors collectively configured to capture an image of the portions of the first object proximate the LCD device.

10. The method of claim 6, wherein the detecting step includes detecting the first object within an image capture area of the display.

11. The gaming system of claim 1, wherein each of the pixels in the array includes a cell perimeter within which are located the at least one light output source and the at least one optical sensor.

12. The gaming system of claim 1, wherein each of the light output sources includes a transparent electrode controlled by a transistor.

13. The gaming system of claim 1, wherein each of the optical sensors is a surface scanning optical sensor, the surface scanning optical sensors acting in cooperation as an optical scanner unit.

14. The gaming system of claim 1, wherein the display is a liquid crystal display (LCD) device, the plurality of light output sources include a first plurality of transistors operable to output images from the LCD device, and the plurality of optical sensors include a second plurality of transistors configured to capture an image of the portions of the first object proximate the LCD device.

15. A gaming system for conducting a wagering game, the gaming system comprising:

a wager input device configured to receive a wager to play the wagering game;

a liquid crystal display (LCD) device with an array of pixel cells, a plurality of output transistors, and a plurality of input transistors, the plurality of output transistors being configured to output images of the wagering game from the LCD device, and the plurality of input transistors being configured to optically capture an image of an object proximate the LCD device, each of the pixel cells including a perimeter within which is located at least one of the input transistors and at least one of the output transistors; and at least one controller configured to:

detect the presence of the object proximate the LCD device, cause the plurality of input transistors to optically capture at least a portion of the object and create a stored image thereof, graphically integrate the stored image of the object into the wagering game, and cause the plurality of output transistors of the LCD device to display at least one outcome of the wagering game which includes one or more symbols comprising at least a portion of the stored image of the object.

* * * * *